US005813780A

United States Patent [19]

Kiyohara et al.

[11] Patent Number: 5,813,780

[45] Date of Patent: Sep. 29, 1998

[54] AUTOMATIC SHEET FEEDING APPARATUS

[75] Inventors: Takehiko Kiyohara, Zama; Tetsuhiro Nitta, Yokohama, both of Japan

[73] Assignee: Canon Kabushiki Kaisha, Tokyo, Japan

[21] Appl. No.: 356,778

[22] Filed: Dec. 12, 1994

Related U.S. Application Data

[63] Continuation of Ser. No. 951,327, Sep. 25, 1992, abandoned, which is a continuation of Ser. No. 581,885, Sep. 13, 1990, abandoned.

[30] Foreign Application Priority Data

| | | | |
|---|---|---|---|
| Sep. 18, 1989 | [JP] | Japan | 1-241374 |
| Sep. 18, 1989 | [JP] | Japan | 1-241375 |
| Sep. 18, 1989 | [JP] | Japan | 1-241376 |
| Sep. 18, 1989 | [JP] | Japan | 1-241377 |

[51] Int. Cl.[6] ..... B41J 11/58

[52] U.S. Cl. ..... 400/629; 400/633.2; 271/127

[58] Field of Search ..... 400/605, 624, 400/625, 629, 633, 633.2; 271/109, 121, 127, 167, 169, 170

[56] References Cited

U.S. PATENT DOCUMENTS

| | | | |
|---|---|---|---|
| 3,339,916 | 9/1967 | Tregay | 271/170 |
| 3,378,252 | 4/1968 | Springer | 271/170 |
| 3,807,725 | 4/1974 | Bookless | 271/170 |
| 4,027,872 | 6/1977 | Bueker | 271/170 |
| 4,031,995 | 6/1977 | Blum et al. | 400/550 |
| 4,273,456 | 6/1981 | Bisczat | 400/550 |
| 4,492,371 | 1/1985 | Kan et al. | 271/170 |
| 4,540,297 | 9/1985 | Imaizumi et al. | 400/625 |
| 4,729,557 | 3/1988 | Kiyohara | 271/272 |
| 4,828,416 | 5/1989 | Pensavechnia | 400/691 |
| 5,096,182 | 3/1992 | Kashimara | 271/170 |

FOREIGN PATENT DOCUMENTS

| | | | |
|---|---|---|---|
| 0227116 | 7/1987 | European Pat. Off. . | |
| 0332275 | 9/1989 | European Pat. Off. . | |
| 47733 | 3/1983 | Japan | 271/170 |
| 191334 | 8/1987 | Japan | 271/170 |
| 282030 | 11/1988 | Japan | 400/629 |
| 214541 | 8/1989 | Japan | 400/629 |

OTHER PUBLICATIONS

*IBM Technical Disclosure Bulletin;* "Buckle Effect Document Separator", M.S. Robbins; vol. 25, No. 1, p. 272; Jun. 1982; 271/169.

*Primary Examiner*—Ren Yan
*Assistant Examiner*—Amanda B. Sandusky
*Attorney, Agent, or Firm*—Fitzpatrick, Cella, Harper & Scinto

[57] ABSTRACT

The present invention provides an automatic sheet feeding apparatus to be freely fixed and unfixed to the recording apparatus having sheet feeding cassette which stores the recording sheet is rotatably fitted in the posture from roughly perpendicular to inclined as against the sheet feed driving unit, and a space to insert the recording sheet is formed when the said sheet feeding cassette is in roughly perpendicular position and the recording sheet is separately fed to the recording apparatus when the said sheet feeding cassette is in inclined position.

35 Claims, 15 Drawing Sheets

AUTOMATIC SHEET FEEDING APPARATUS

This application is a continuation of application Ser. No. 07/951,327 filed Sep. 25, 1992, now abandoned which is a continuation of Ser. No. 07/581,885 filed Sep. 13, 1990, now abandoned.

BACKGROUND OF THE INVENTION

1. Field of the Invention

The present invention relates to an automatic sheet feeding apparatus, to be more precise, for example, an external automatic sheet feeding apparatus which can be fixed or unfixed freely to the recording apparatus.

2. Related Background Art

Recording apparatus such as printer, copying machine, facsimile etc. are so constructed that the image composed of dot patterns are recorded on the recording sheet made of paper, plastic etc. by driving the energy generating member of the recording head according to the transmitted image data. The said recording apparatus may be classified into ink jet type, wire dot type, thermal type, laser beam type etc., according to the type of recording system.

The kinds of recording sheet used for the recording apparatus are ordinary paper, thick paper such as postcard, envelope, special sheet such as thin plastic sheet, etc. Recording sheet is fed to the apparatus by manually inserting it sheet by sheet or fed automatically and continuously by an automatic sheet feeding apparatus.

The said automatic sheet feeding apparatus is generally equipped with a sheet feed driving unit to deliver the recording sheet by turning the sheet feeding roller and the sheet feeding cassette which stores the recording sheet, the said apparatus being so constructed that the recording sheet is supplied sheet by sheet by driving the said sheet feed driving unit in synchronization with the sheet delivery system of the recording apparatus. Automatic sheet feeding apparatus is divided into the built-in type which is built into the recording apparatus and the external type wherein the unit is mounted or dismounted freely to the apparatus, while the present invention is related to the latter external type automatic sheet feeding apparatus.

For the recording unit, the horizontal type is generally employed, wherein the sheet inserting hole and sheet discharge hole are provided at the upper surface of the apparatus and the sheet is delivered along the recording sheet transporting routes formed in U-letter shape in the recording apparatus.

However in the case of the conventional external automatic sheet feeding apparatus, the apparatus is mounted on the upper surface of the recording apparatus at certain posture and the recording apparatus is horizontally installed for use, thus requiring considerable installation space.

SUMMARY OF THE INVENTION

The present invention has been made in the light of the aforesaid technical problems of the conventional system with the objective to furnish an automatic sheet feeding apparatus which can set the recording sheet of a simple and compact mechanism and which can be stored in more compact style so that the space efficiency is improved.

The present invention relates to the automatic sheet feeding apparatus which can be freely fixed or unfixed to the recording apparatus wherein the sheet feeding cassette which stores the recording sheet is rotatory fixed at the posture from roughly perpendicular to inclined as against the sheet feed driving unit, and a space to insert recording sheet is formed when the said sheet feeding cassette is positioned roughly perpendicular and the recording sheet is individually fed to the recording apparatus when the said cassette is inclined, thus enabling to set the recording sheet by a simple and compact construction and at the storage the apparatus can be made even more compact to increase the space efficiency.

According to the present invention, the automatic sheet feeding apparatus which is freely fixed or unfixed to the recording apparatus is constructed in such manner that the sheet feeding cassette which stores the recording sheet is rotatory fixed with the posture from roughly perpendicular to inclined as against the sheet feed driving unit and a space to insert the recording sheet is formed when the said cassette is roughly perpendicular and the recording sheet is individually fed to the recording apparatus when the said cassette is inclined. Thus an automatic sheet feeding apparatus which can set the recording sheet by simple and compact construction and can be made more compact at storage to increase the space efficiency is obtained.

Alternatively, it is also possible to so construct the apparatus that the sheet feeding force of the sheet feeding system is not produced when the said sheet feeding cassette is roughly perpendicular. When it is so constructed, it is possible to differentiate automatic sheet feeding and manual feeding with certainty to obtain the effect to eliminate the trouble such as clogging of paper by double feeding of recording sheet.

Further, it is also possible to construct the apparatus in such manner that the recording sheet is fed manually to the recording apparatus when the said sheet feeding cassette is roughly perpendicular. By so doing, it is possible to freely practice manual feeding of the recording sheet even when the automatic sheet feeding apparatus is fixed to the recording apparatus.

It is also possible to employ such construction that the sheet feeding mode and sheet set mode can be changed over and in the sheet feeding mode, the means to prevent entry of sheet for prevention of double insertion is provided. By doing so it is possible to obtain an automatic sheet feeding apparatus wherein insertion (replenishing) of recording sheet at sheet feeding mode is prevented and with certainly and occurrence of trouble due to erroneous insertion of recording sheet can be eliminated without an additional mechanism.

Alternatively, it is also possible to employ such construction that the sheet feeding cassette which stores the recording sheet is rotatory fixed in the posture from roughly perpendicular to inclined as against the sheet feed driving unit and the apparatus is placed in sheet set mode forming recording sheet insertion passage when the said sheet feeding cassette is roughly perpendicular and sheet feeding mode to feed recording sheet individually when the said sheet feeding cassette is inclined and in addition the apparatus is provided with a sheet entry prevention lever which is held in such way that the sheet insertion passage is closed in sheet feeding mode and opened in sheet set mode. Thereby an automatic sheet feeding apparatus is obtained wherein the insertion (replenishing) of recording sheet at sheet feeding mode is prevented with certainty and occurrence of trouble due to erroneous insertion of recording sheet is eliminated with extremely simple structure without an additional mechanism or control.

As aforesaid the automatic sheet feeding apparatus which feeds the stored recording sheet one by one by rotating the sheet feeding roller is so constructed that a side guide and separation claw for handling recording sheet is provided to the slider which can adjust the space in the direction of width of the recording sheets, the position of the said sheet feeding roller in width direction of the recording sheet is fixed, a dummy roller having roughly the same profile with the said sheet feeding roller which slidingly rotates as against the recording sheet is fixed to the rotary shaft of the said sheet feeding roller and thus either the said sheet feeding roller or the said dummy roller contacts at the part within the specified distance from the said separation claw. As the result, with a simple construction, one can obtain an automatic sheet feeding apparatus wherein the sheet is held within a proper range from the separation claw even when the width of the recording sheet changes with the construction that the position of sheet feeding roller is fixed in width direction and a proper loop for separation of sheet is obtained and a smooth sheet feeding action is ensured.

With the automatic sheet feeding apparatus the sheet feeding unit thereof being equipped with the slider provided with the side guide movable in the width direction of the recording sheet, the apparatus is so constructed that a dovetail type guide rail extending horizontally in the width direction of recording sheet is provided to the sheet feeding unit at the position which leaves a preset space, the said slider supports the guide having the sloped plane engaging with the dovetail groove at the inside of the said guide rail and at the adjustment of the width of the recording sheet, the said guide is guided by bringing the sloped plane of the said guide in contact with the said dovetail groove. As the result, an automatic sheet feeding apparatus is obtained wherein the moving resistance of the slider having the side guide is substantially reduced, the separation claw can be easily and correctly set as against the recording sheet and a stable separation and feeding of recording sheet can be made.

Since the apparatus is so constructed that at least one of the said guides is supported by an elastic means so that it is pressed against the inner surface of the said dovetail groove, it is possible to eliminate the play of the guide and make the motion of the slider smooth, thus enabling a stable separation and feeding of the recording sheet with a high operability.

DESCRIPTION OF THE PREFERRED EMBODIMENT

Figure 3:
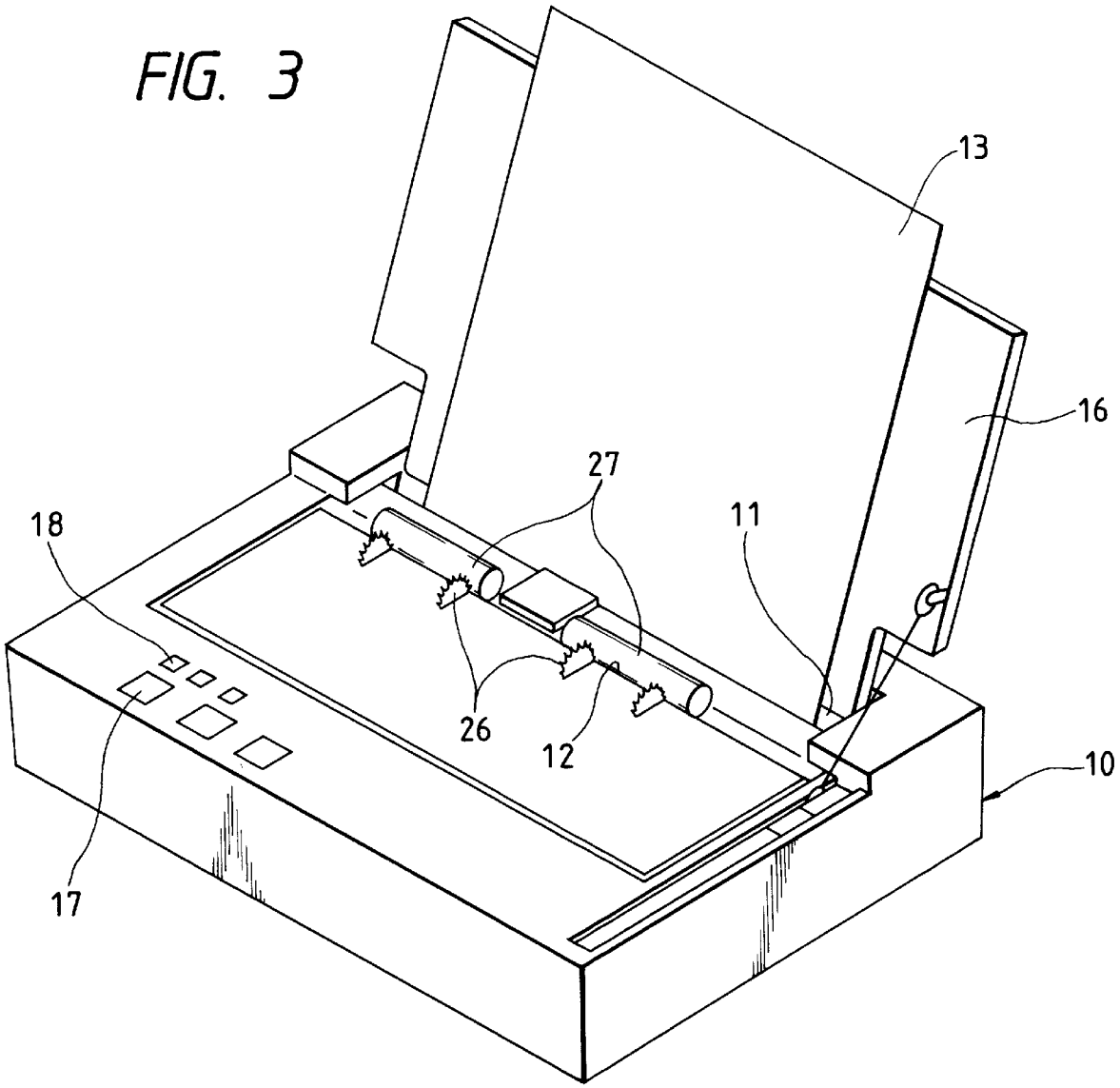
FIG. 3 is the typical diagonal view to show the state of use of the main body of the recording apparatus of FIG. 1 installed horizontally.
Figure 4:
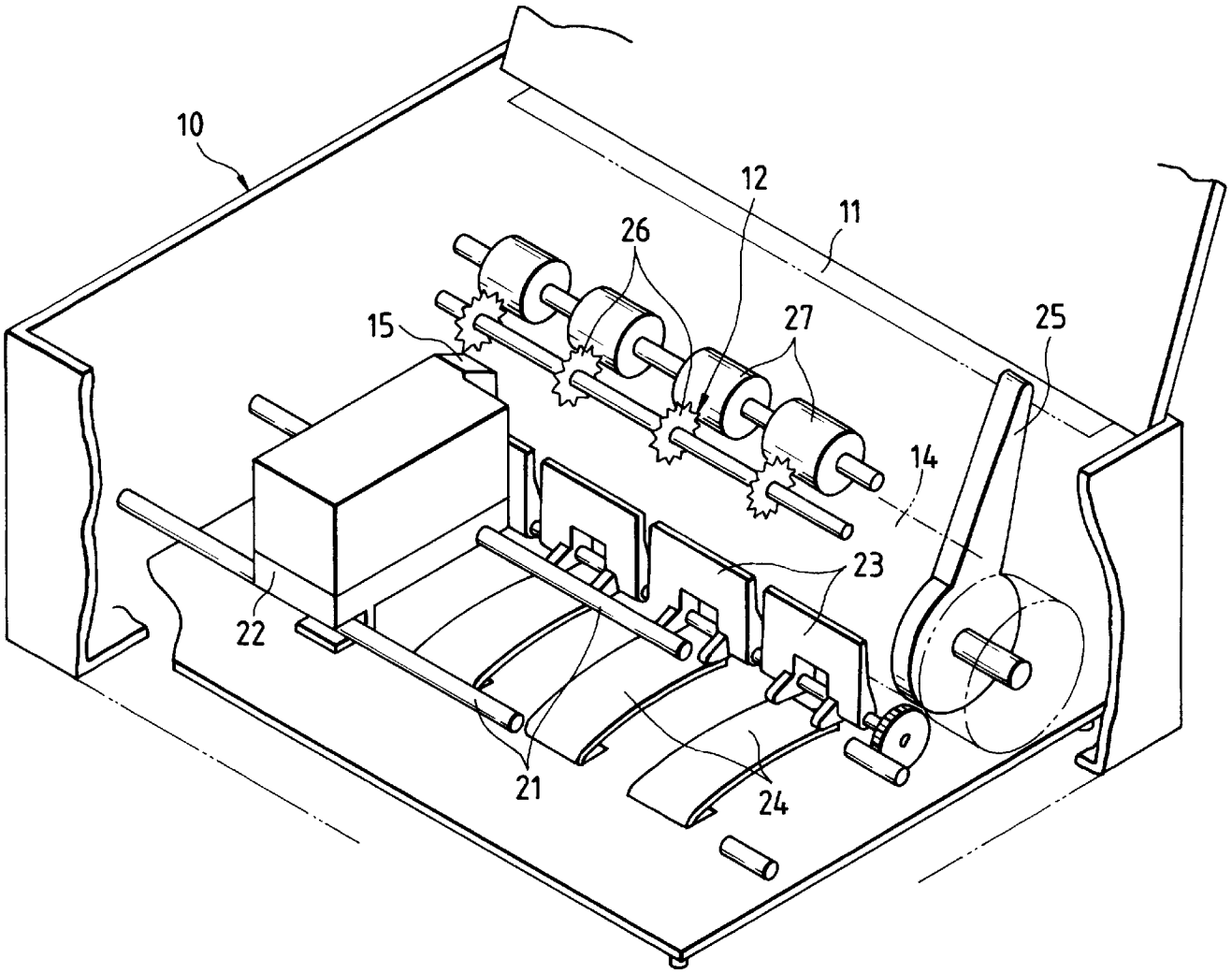
FIG. 4 is a partial broken-out diagonal view to show the typical rough construction inside the recording apparatus.

FIG. 3 is the diagonal view to show the state of use of the horizontal recording apparatus (main body) 10 which is a preferred embodiment of the present invention and FIG. 4 is the diagonal view to show the rough construction of the inside of the recording apparatus of FIG. 3.

In FIGS. 3 and 4, a sheet inserting hole 11 and sheet discharge hole 12 are provided at the upper surface of the recording apparatus 10 (for example, a recording apparatus to employ bubble jet recording method wherein the image is formed by the recording liquid which forms drops of recording liquid utilizing the thermal energy). Recording sheet 13 inserted through the sheet inserting hole 11 is made to tightly contact the circumferential surface of platen roller 14 which works concurrently as the sheet feeding roll, the said sheet being delivered in the direction of arrow along the recording sheet transporting route formed roughly in letter U shape (FIGS. 1 and 2) and recorded as it passes through the recording unit which faces the recording head 15 and discharged upward through the recorded sheet discharge hole 12.

Figure 2:
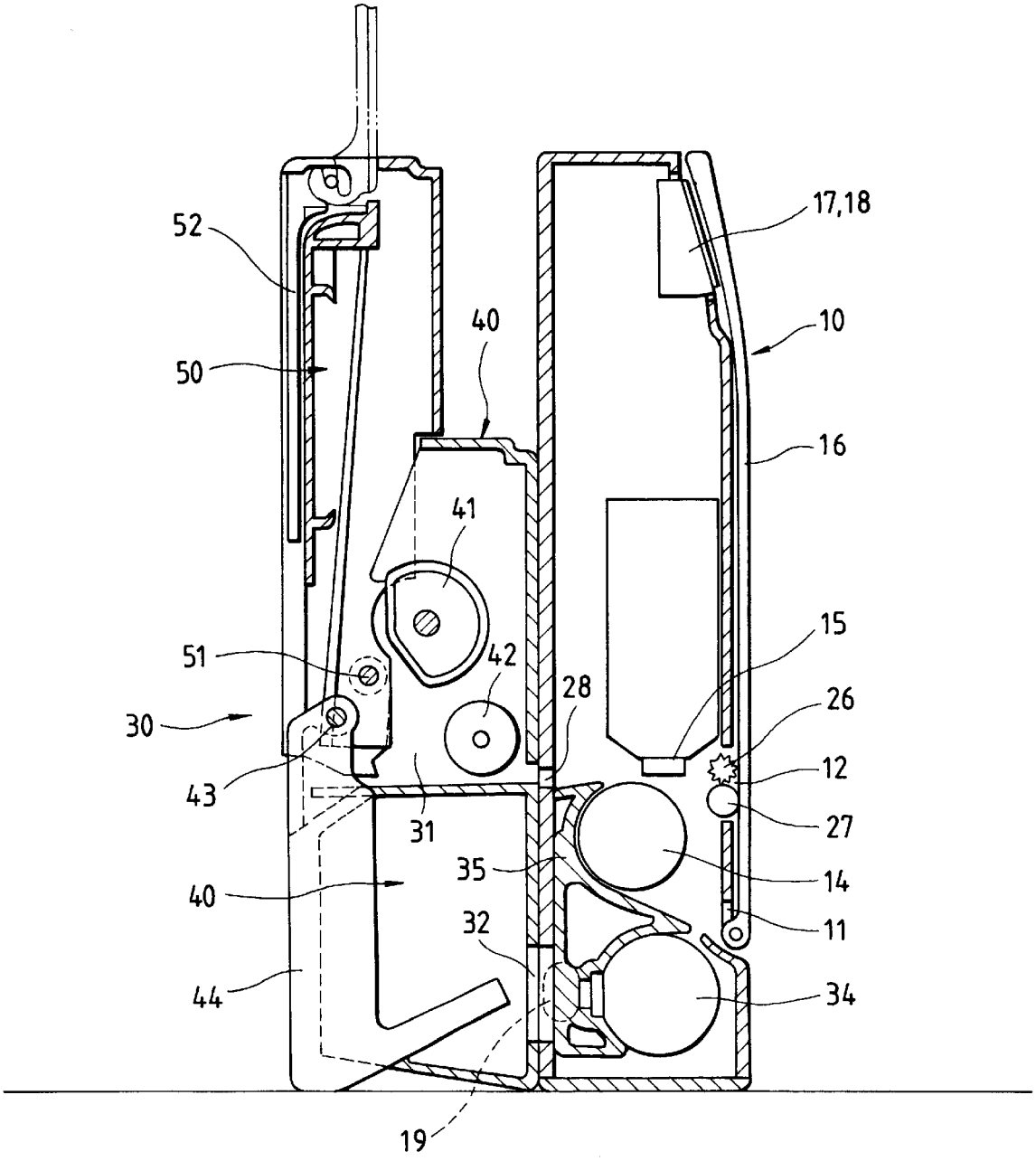
FIG. 2 is the typical longitudinal section drawing to show the state of the recording apparatus of FIG. 1 in storage.

Here, the sheet feed traying 16 is axially fitted at the upper plane of recording apparatus 10 in such manner that it can open and close and when in use (at recording) it opens to function as the sheet feeding tray and when it is not in use, it is set at the closed position as shown in FIG. 2 and functions as the cover 16 to protect and cover the upper surface of the recording apparatus 10 where the sheet inserting hole 11, sheet discharge hole 12, switches 17, indicator 18 etc. are arranged.

In FIG. 4, recording head 15 is mounted on the carriage 22 which makes reciprocal movement along the guide axis 21 and 21 that are parallel to the platen roller 14. The recording head 15 shown in the Figure indicates the case of ink jet head which is made into one unit with the ink tank.

At the upper stream in the carrying direction of the recording head 15 is the sheet holding plate 23 which presses the sheet against the platen roller 14. This sheet holder 23 is pressed against the circumferential plane of platen roller 14 by plate spring 24.

The pressing force of the said sheet holding plate 23 can be released by controlling the lever 25 which is axially supported by the axis of platen roller 14. At the position of sheet discharge hole 12 are the wheel 26 and roller 27 which assist the discharge of recording sheet 13.

Figure 5:
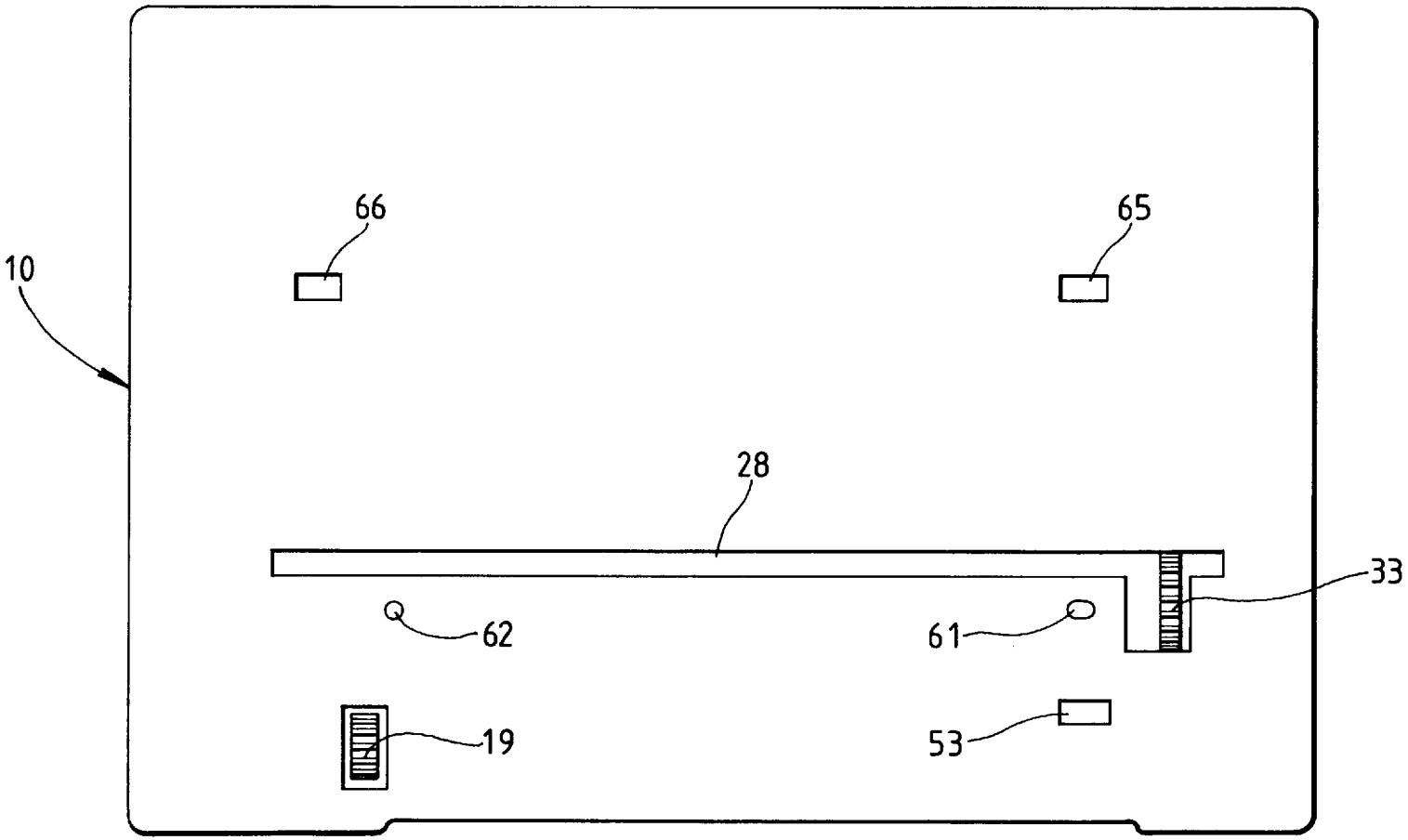
FIG. 5 is the typical base drawing to show the base of the recording apparatus of FIG. 3.

FIG. 5 is the drawing to indicate the base of the recording apparatus (main body) 10 (it becomes the back when the apparatus takes vertical posture as stated later).

At the base of recording apparatus 10 is formed the second sheet inserting hole 28 which is so constructed that the roughly linear second recording sheet carrying route extends roughly in up-down direction from the said inserting hole 28 up to the said sheet discharge hole 12 through the recording section located in between the recording head 15 and platen roller 14. This second recording sheet carrying route is usable when the recording apparatus 10 is installed in vertical position as stated later (FIGS. 1 and 2) and since it is not bent, it provides such advantage that the thick sheet such as postcard or envelope or the recording sheet with rigidity such as the plastic sheet and other special sheet can be easily delivered.

The aforesaid recording apparatus 10 can be used in the vertical posture and when it takes the vertical position, the automatic sheet feeding apparatus can be freely fixed or unfixed and the sheet may be fed automatically through the sheet inserting hole 28 at the back (in the vertical position).

Figure 1:
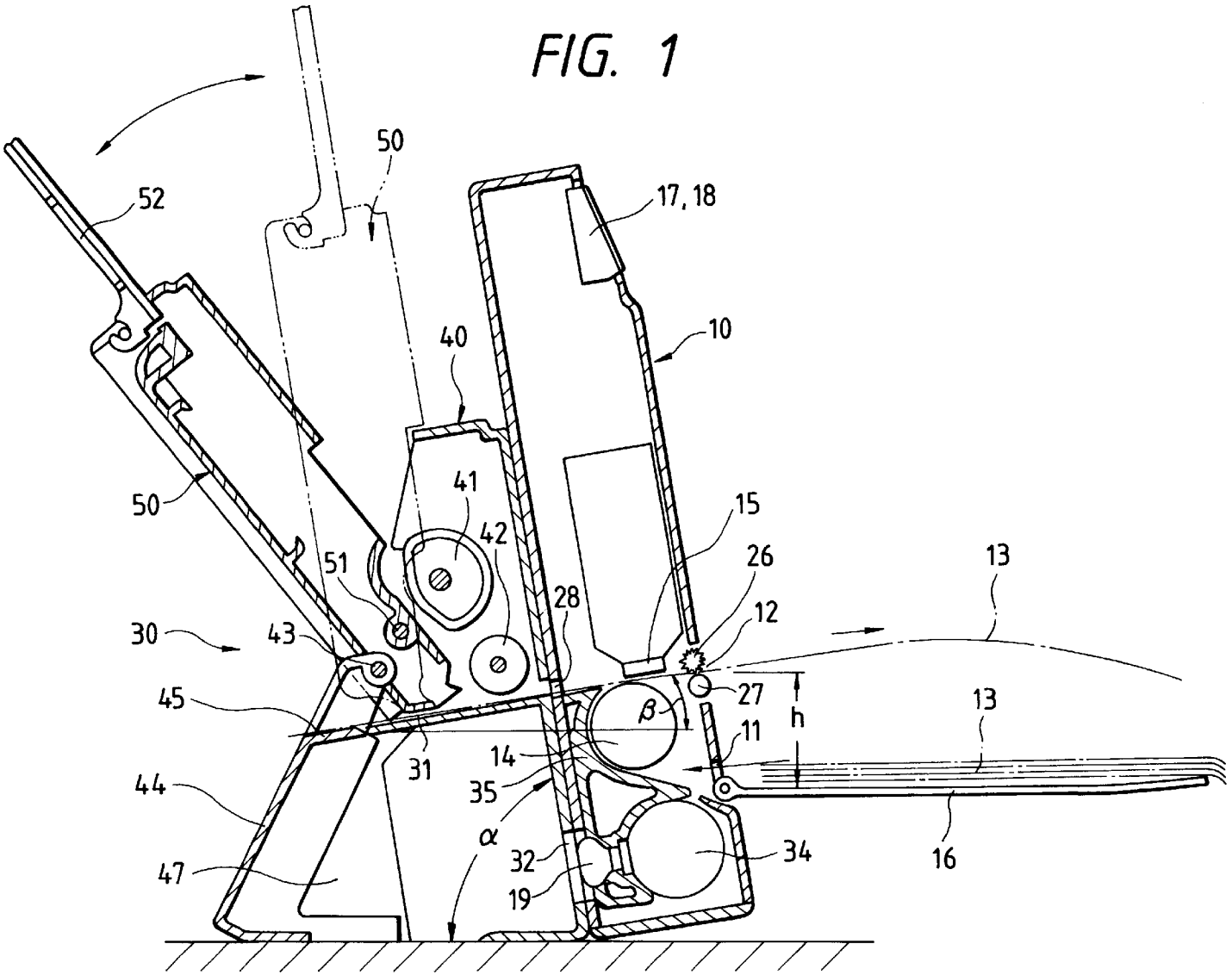
FIG. 1 is the typical drawing to show the longitudinal section in use of the recording apparatus equipped with the automatic sheet feeding apparatus embodying the present invention.

FIG. 1 and FIG. 2 are the longitudinal sectional drawings of the state where the automatic sheet feeding apparatus 30 is fixed to the back of the recording apparatus installed in vertical position, wherein FIG. 1 shows the state in use (upon recording) and FIG. 2 shows the state in storage.

In FIGS. 1 and 2, when the recording apparatus 10 is installed in vertical position, a roughly linear recording sheet carrying route passing through the recording section (in between the recording head 15 and platen roller 14), that is, the carrying route from the second sheet inserting hole 28 up to the sheet discharge hole 12 is formed.

Here, the automatic sheet feeding apparatus 30 is set at such position that it feeds the recording sheet 13 to the said linear carrying route from the inlet (sheet inserting hole) 28 and it is fixed to the back side (the side at which the inlet 28 opens) of the recording apparatus 10 in the way that it can be freely fixed and unfixed. The automatic sheet feeding apparatus is also equipped with the linear sheet passage 31 for feeding recording sheet which is connected roughly linearly to the said almost linear recording sheet carrying route, apart from the automatic sheet feeding mechanism to be stated later.

This sheet passage 31 is a sheet insertion guide passage to feed the recording sheet manually and it is closed in the mode where automatic sheet feeding is possible as shown by the solid line in FIG. 1 and it is opened in the mode of sheet set shown by 2-dot chain line where automatic sheet feeding is impossible so that manual insertion becomes possible.

Automatic sheet feeding apparatus 30 is composed of the sheet feed driving unit 40 which is connected to the recording apparatus 10 in fixed state and sheet feeding cassette 50 rotatory fixed with the posture from roughly perpendicular to inclined as against the said sheet feed driving unit 40.

Figure 6:
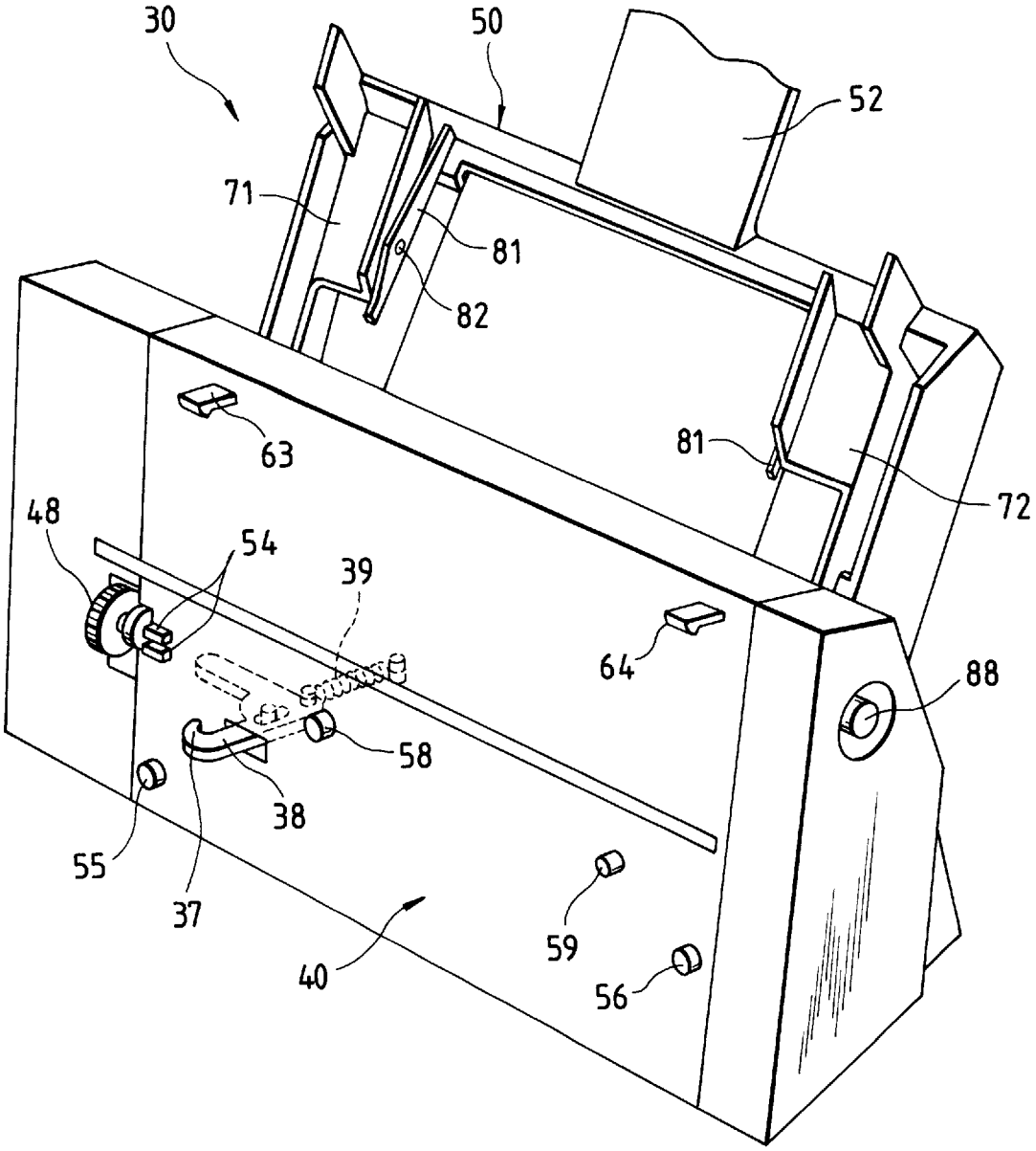
FIG. 6 is the typical diagonal view of the automatic sheet feeding apparatus of FIG. 1 viewed from the fitting plane side.

FIG. 6 is a diagonal view of the automatic sheet feeding apparatus 30 in the state of FIG. 1 as viewed from the plane connected to the recording apparatus 10.

The said sheet feeding cassette 50 stores the recording sheet 13 at the set position and the said sheet feed driving unit 40 delivers the stored recorded sheet 13 one by one to the recording apparatus 10.

In FIGS. 1, 2 and 6, the sheet feeding cassette 50 is movable axially and rotatably (being able to open and close) around fulcrum 51 at a position facing the upper half of sheet feed driving unit 40. At the point of sheet feed driving unit 40 where it faces the sheet feeding cassette 50 are fixed a sheet feeding roller 41 and auxiliary feeding roller 42.

A foldable sheet feeding tray 52 is fixed to the sheet feeding cassette 50 and at the time of use, it is drawn out to form a tray as shown in FIG. 1 and at the time of storage, it can be folded into the cassette unit 50 as shown in FIG. 2.

A section of the lower part of the casing of sheet feed driving unit is composed of the movable member 44 which is rotatory (or being able to open and close) fixed around the fulcrum 43 and the said movable member 44 is opened at the time of use forming the support. Said movable member 44 is closed at the time of storage as shown in FIG. 2.

An opening 32 is formed at the wall facing the recording apparatus 10 of the movable member 44 which forms the open-close support.

On the other hand, change-over switches 19 such as AC/DC change-over switch which is operated at the said back surface (or the base when installed horizontally) is provided at the lower part of the back of the recording apparatus 10. The said opening 32 is provided at the position corresponding to the switches 19 so that the switches can be operated through such opening 32 even when automatic sheet feeding apparatus 30 is mounted.

Thus, the operator can not control the change-over switches 19 when the movable member 44 (open-close support) is closed (FIG. 2) because the support is closed thereby but when said movable member 44 is in the open state (FIG. 1), the open section 47 is formed at the support as shown in the Figure and the change-over switches can be operated.

Said movable member 44 is provided with the shelf which forms the table 45 for supporting the sheet when the movable member 44 opens at the inlet of the said sheet passage 31 for manual sheet insertion. Said table formed by the shelf 45 utilizes the movable member 44 and it complements the roughly linear sheet passage 31 which extends to the linear recording sheet transporting route of recording apparatus 10, so that the recording sheet 13 is easily and correctly inserted.

Recording apparatus 10 installed vertically and provided with the automatic sheet feeding apparatus 30 is brought into the storage conditions by folding the said cover (sheet discharge tray) 16 as shown in FIG. 2, holding the sheet feeding cassette in perpendicular position and closing the movable member (support) 44. At such storage conditions, the profile of the apparatus takes roughly the profile of rectangular parallelopiped with flat bottom and it is folded into a compact upright posture without projections.

In the state of use as shown in FIG. 1, the cover 16 is unfolded to form the sheet discharge tray and movable member (support) 44 is opened to bring the apparatus in a stable posture inclined by preset angle $\alpha$ (for example, 65° to 85°) as shown in the Figure. The lower casing of sheet feed driving unit 40 is so constructed that it forms a flat bottom inclined by the preset angle when movable member 44 is opened as shown in the Figure.

Recording sheet 13 is set in the sheet feeding cassette 50 as it is in closed state (perpendicular position).

After preparing the apparatus in the state to enable recording, the recording action is started by opening (inclining) the sheet feeding cassette 50 as shown by the solid line in the case of recording by automatic sheet feeding.

When recording is conducted by manual sheet feeding, the sheet feeding cassette 50 is held in perpendicular (closed) position and the recording sheet 13 is fed to the recording apparatus 10 through table 45 and sheet passage 31.

Here, as shown in FIG. 1, when the apparatus is used, as the movable member 44 is kept open, the linear recording sheet transporting route of recording apparatus 10 and the sheet passage 31 (including table 45) at the side of automatic sheet feeding apparatus are inclined upward in the direction of sheet discharge by the preset angle β (5°~25°).

At the side outlet (sheet discharge hole) 12 of recording sheet transporting route of recording apparatus 10 is provided a sheet discharge tray which is formed by unfolding the said cover 16. This sheet discharge tray 16 is so fixed that it extends roughly in horizontal direction at the position lower than the sheet discharge hole 12 by preset elevation h, as shown in the Figure.

When the sheet discharge tray 16 is so arranged, it is possible to discharge the recording sheet 13 without bringing it is contact with the recording sheet 13 on the sheet discharge tray 16 and consequently it is possible to prevent contamination of ink due to contact with unfixed recording ink, particularly in the case of ink jet recording apparatus etc. where recording is conducted by applying liquid ink.

Next the structure of connection of recording apparatus 10 and automatic sheet feeding apparatus 30 is explained.

Figure 7:
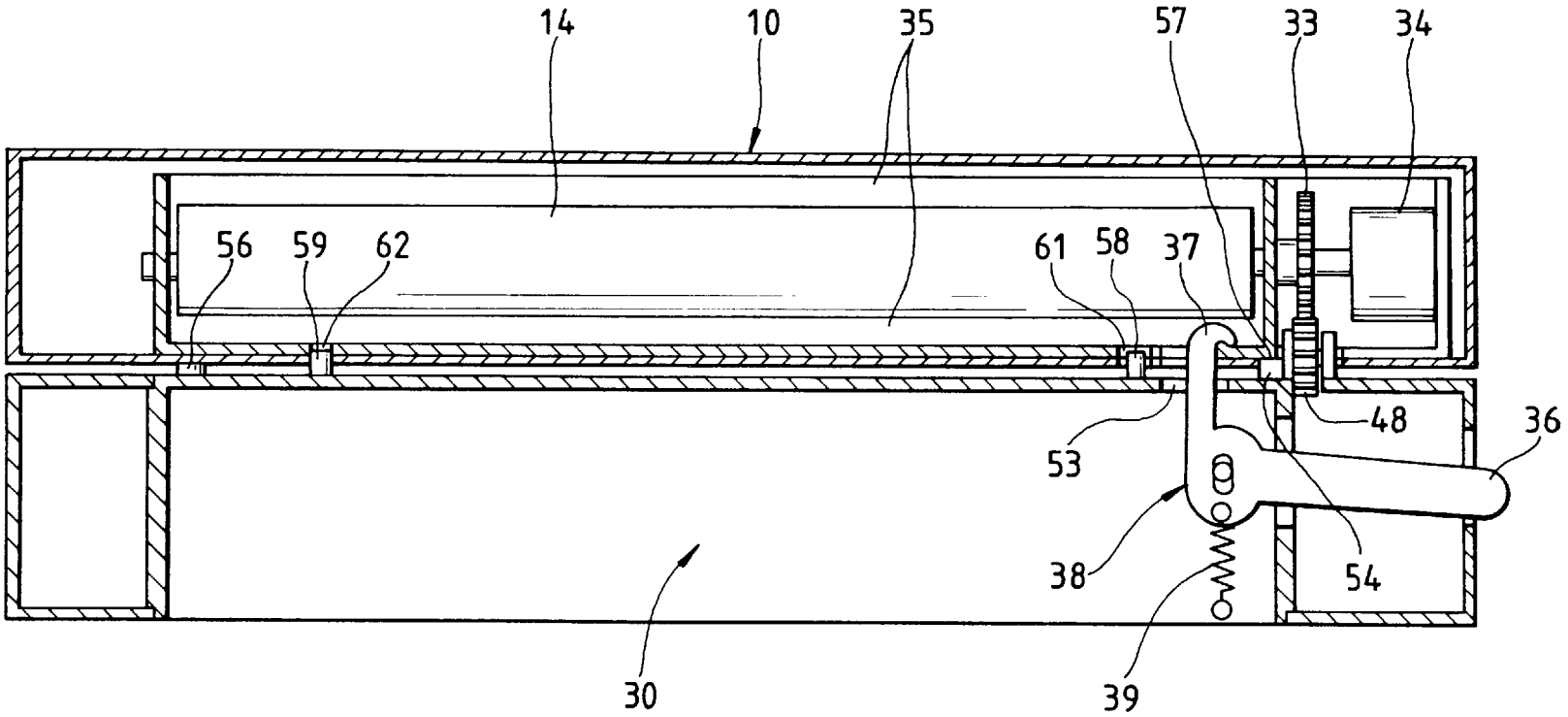
FIG. 7 is the sectional drawing of key part to show the state of locking of the connecting part between the main body of the recording apparatus and the automatic sheet feeding apparatus.
Figure 8:
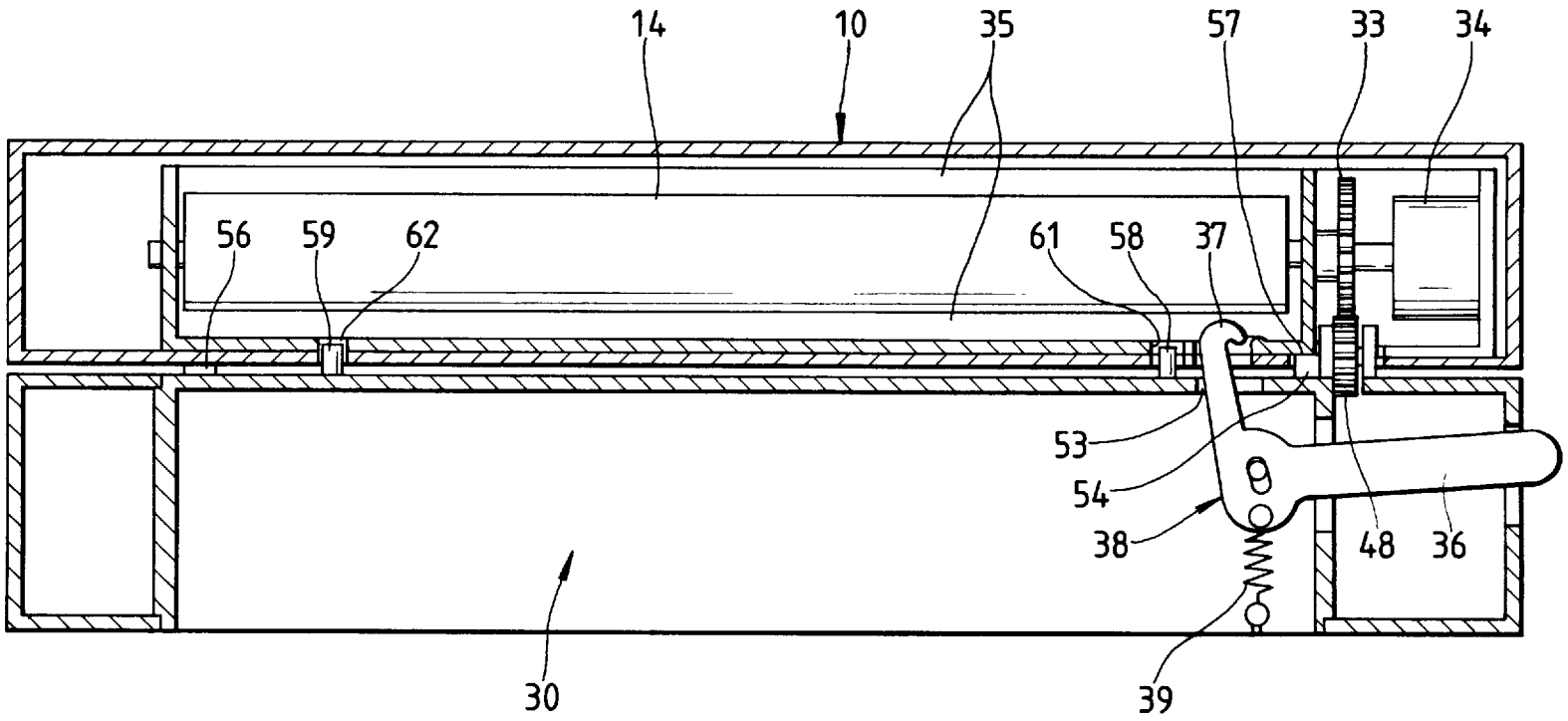
FIG. 8 is the sectional drawing of key part to show the state of unlocking of the connecting part shown in FIG. 7.

FIG. 7 is the horizontal sectional view to show the state of connection between the recording apparatus 10 and automatic sheet feeding apparatus 30, and FIG. 8 is the state where lock is released after the state of FIG. 7.

First, at the back of the recording apparatus 10 is axially supported the driving gear 33 which rotates in synchronous with the platen roller 14 as shown in FIGS. 5, 7 and 8, and on the other hand, at the side where automatic sheet feeding apparatus 30 is mounted, the driven gear 48 which can transmit the rotary force to the sheet feeding roller 41 is axially supported.

At the time of connection, these gears 33 and 48 are geared in to transmit the driving force of sheet feeding roller 41 to the automatic sheet feeding apparatus.

At the inside of the recording apparatus 10 exists a frame member 35 which supports the platen roller 14 and bearing units of sheet carrying motor 34 etc. and the casing is fixed to the said frame member 35. Lever 36 and hook member 38 having front end hook 37 are fixed to the automatic sheet feeding apparatus 30 in the way to enable swinging and moving to and for preset distance and the hook member 38 is pushed toward inside by the tension spring 39.

An opening 53 into which the said hook 37 enters via the opening of the casing is formed at the position corresponding to the said hook 37 of the said frame member 35 of the recording apparatus 10 and hook 37 is engaged with the periphery of the opening 53. As shown in FIG. 7 and FIG. 8, at the periphery of the said opening 53 is formed the beading section so that the engagement of the said hook 37 should be smoothly made.

In the state where the hook 37 is engaged as shown in FIG. 7, the tension spring 39 extends (for example by 1~2 mm) and by its spring force, automatic sheet feeding apparatus 30 is pressed against the recording apparatus 10 and connected thereto.

The locking of the hook member 38 is released when the lever 36 is picked up and rotated as shown in FIG. 8 and automatic sheet feeding apparatus can be disengaged from the recording apparatus 10. Contact pressure under such state of connection is born by the contact surface at three places.

As shown in FIGS. 5~7, at the side of automatic sheet feeding apparatus 30 are formed the 1st contact surface 54 which constitutes the standard contact surface and 2nd and 3rd contact surfaces 55 and 56. The said standard contact surface 54 is provided at the place near the driven gear 48 as shown in the Figure. The standard contact surface 57 which is the opposite surface of the standard contact surface 54 is formed at the said frame member 35 having a high strength and rigidity and it is set at the position near the gearing point of gears 33 and 48.

The working line of the said hook member 38 which provides the pressure of contact to the connecting part is located at the place where it provides a stable connection taking into account the position of three contact planes 54, 55 and 56. The second and third contact planes 55 and 56 may be made to contact directly to the back of the recording apparatus 10.

Position setting pins 58 and 59 are formed at the mounting place of automatic sheet feeding apparatus and by engaging these pins 58 and 59 with the position setting holes 61 and 62 formed at the back of the recording apparatus 10, the position of automatic sheet feeding apparatus 30 is set relative to the recording apparatus 10. Out of the two position setting holes 61 and 62, the hole 61 is an oblong hole as shown in FIG. 5.

Further, at the mounting plane of automatic sheet feeding apparatus 30 and recording apparatus 10 are provided the auxiliary hooks 63 and 64 and auxiliary racks 65 and 66 (FIG. 5) which are connected (engaged) when deflection occurs due to an external force loaded on the main body of the recording apparatus 10 and automatic sheet feeding apparatus 30.

Figure 9:
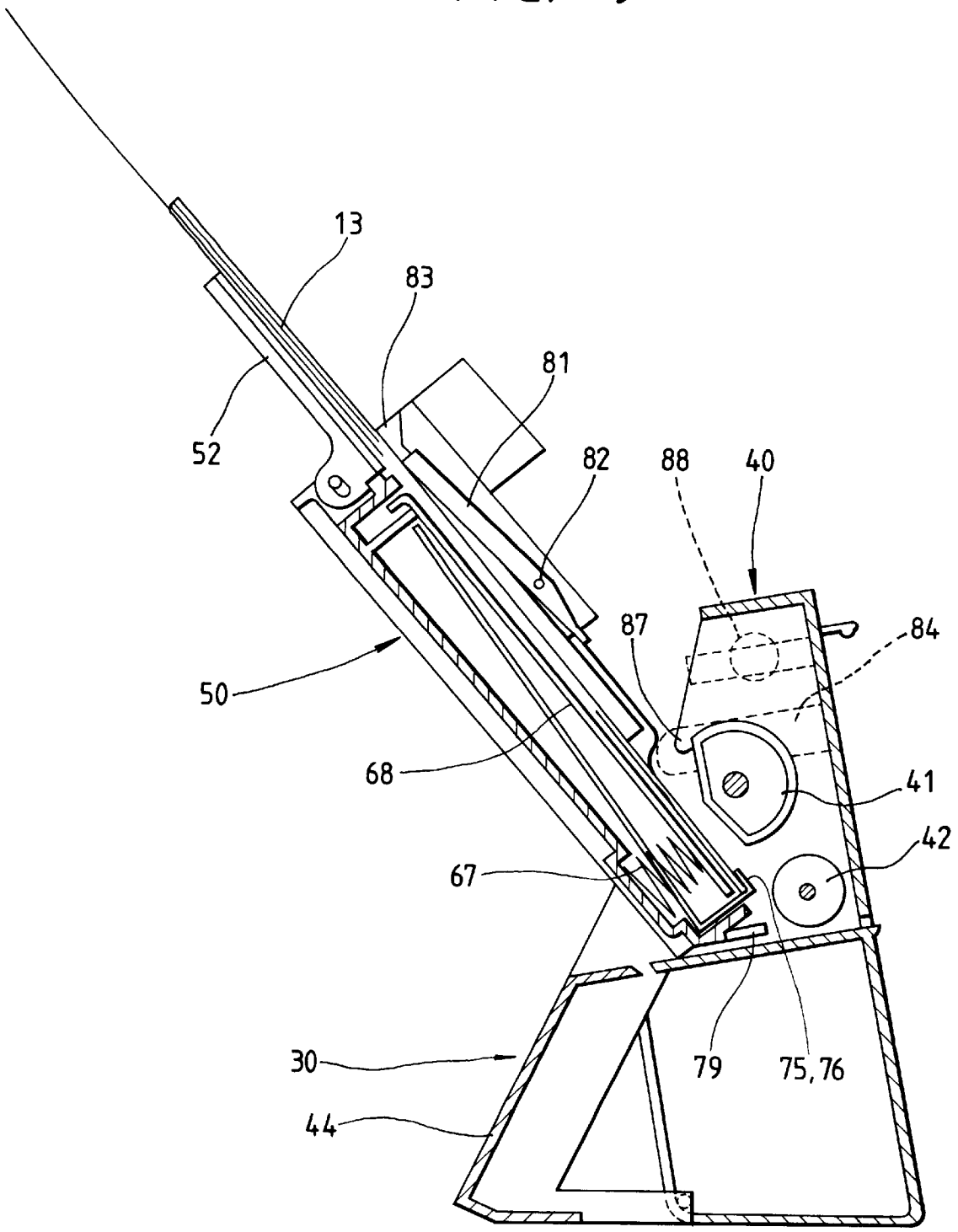
FIG. 9 is the typical longitudinal sectional drawing of the state of sheet feeding of automatic sheet feeding apparatus.
Figure 10:
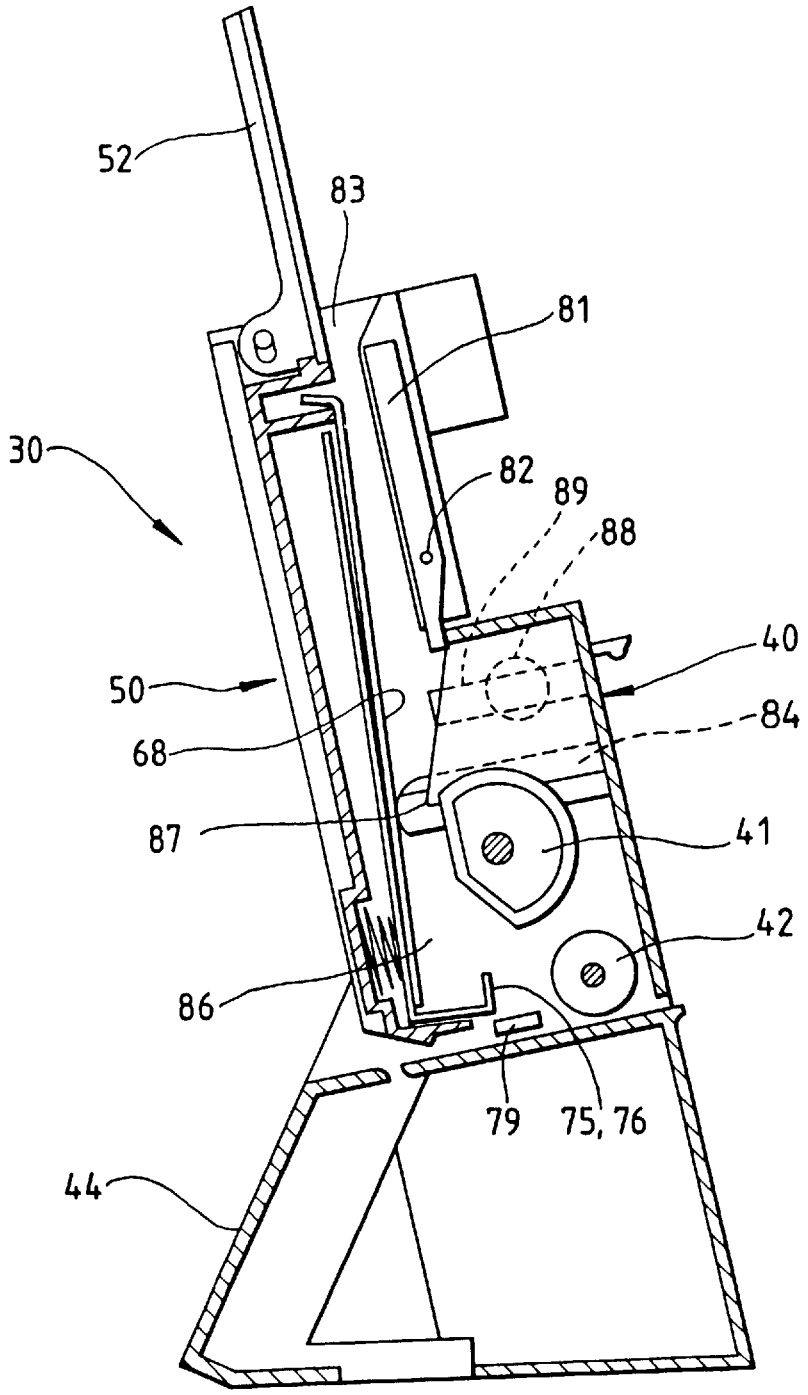
FIG. 10 is the typical longitudinal sectional drawing to show the state of sheet setting of automatic sheet feeding apparatus of FIG. 9.

FIG. 9 is the longitudinal sectional drawing of automatic sheet feeding apparatus 30 in the sheet feeding (inclined) state, while FIG. 10 is the longitudinal sectional drawing of the automatic sheet feeding apparatus 30 in the sheet set (perpendicular) state. In the two drawings, sheet feeding cassette 50 is provided with the pressure plate 68 which is pressed against the sheet feeding roller 41 by pressure plate spring 67. Sliders 71 and 72 (FIG. 11) whose width direction space can be adjusted according to the width of recording sheet 13 is guided and supported by the sheet feeding cassette 50.

Figure 11:
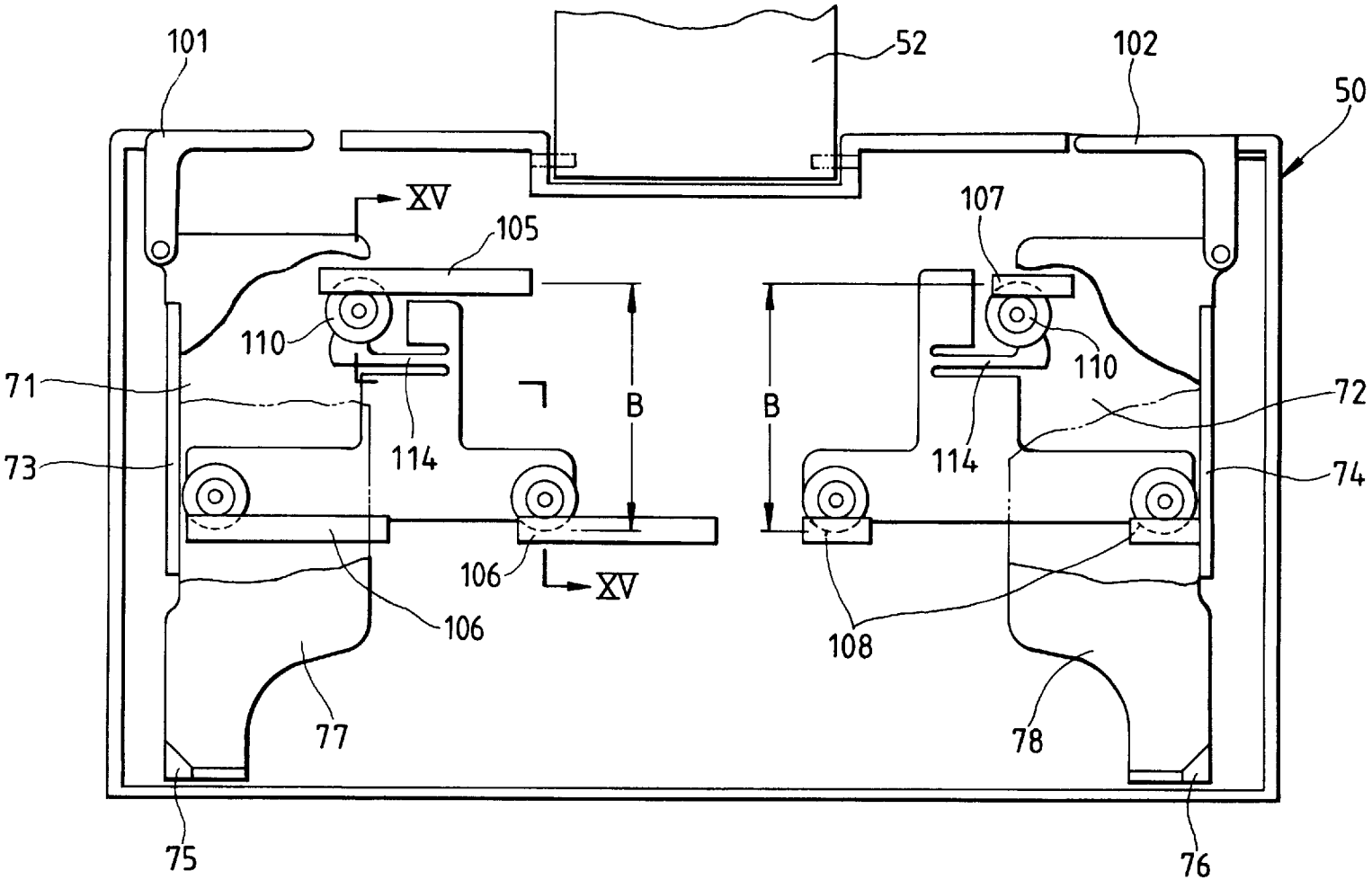
FIG. 11 is a partially omitted front view of the sheet feeding cassette of automatic sheet feeding apparatus of FIG. 9.
Figure 12:
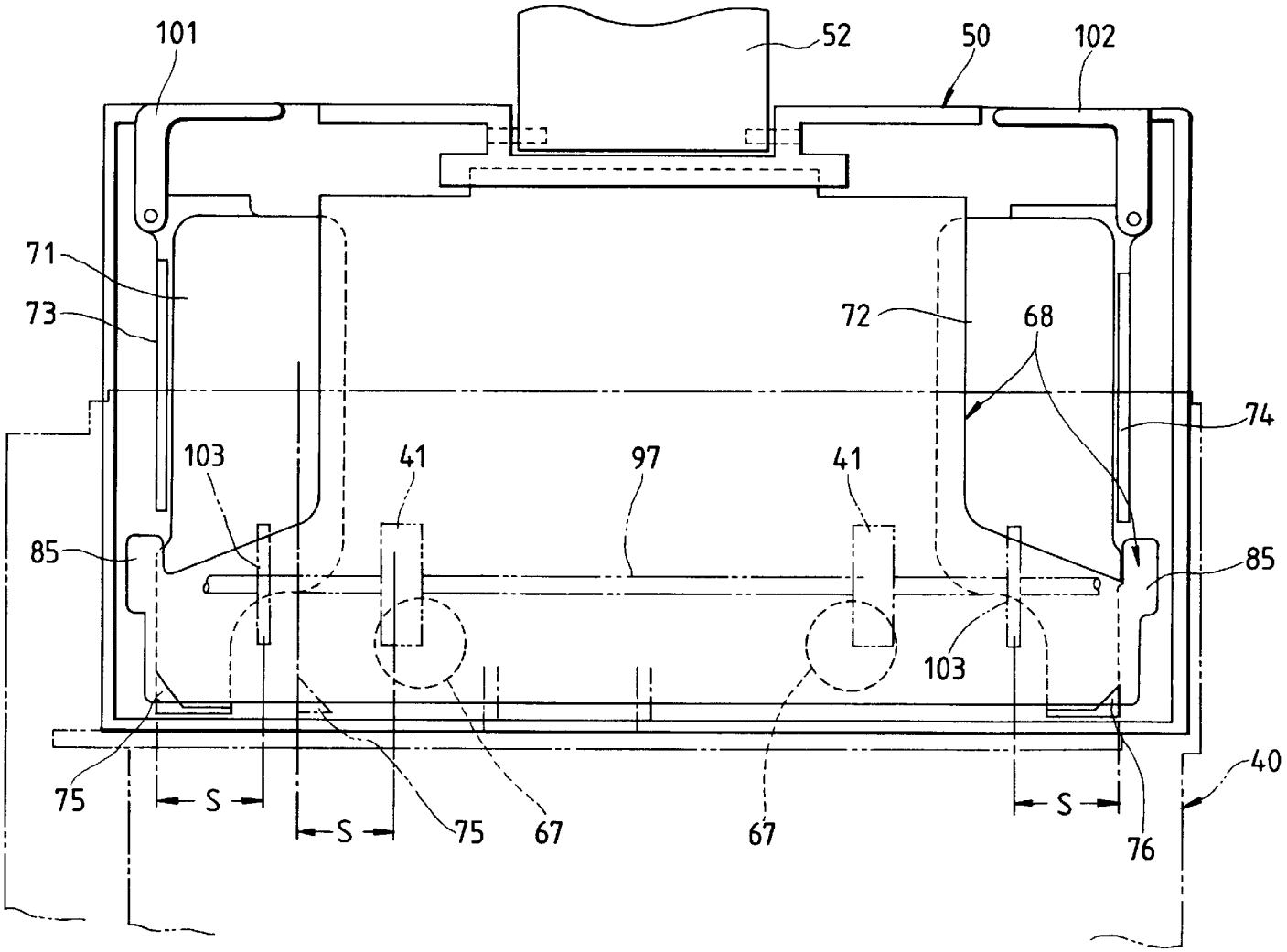
FIG. 12 is the front view of the sheet feeding cassette of automatic sheet feeding apparatus of FIG. 9.

FIG. 11 is the partial broken-out front view of sheet feeding cassette 50 which shows the sliders 71 and 72, while FIG. 12 is the partial broken-out front view of sheet feeding cassette 50 which indicates the pressure plate 68 in addition to the sliders 71 and 72.

Each slider 71 and 72 is provided with the side guides 73, 74 which contact the edges at two sides of the loaded recording sheet 13 and the law members 77, 78 having separation claws 75, 76 which hold from above two corners at the front end the loaded recording sheet 13, the spaces of such members being adjustable just like the sliders 71 and 72.

As shown in FIG. 9, the stored recorded sheet 13 is maintained in between the said pressure plate 68 and the said separation claws 75 and 76 at sheet feeding time, a semi-circular sheet feeding roller 41 rotates and contacts the recording sheet 13 to produce delivery force and while it is rotating one round, the top most one sheet is separated and fed up to the engagement point in the recording apparatus 10 via the auxiliary roller 42.

Figure 13:
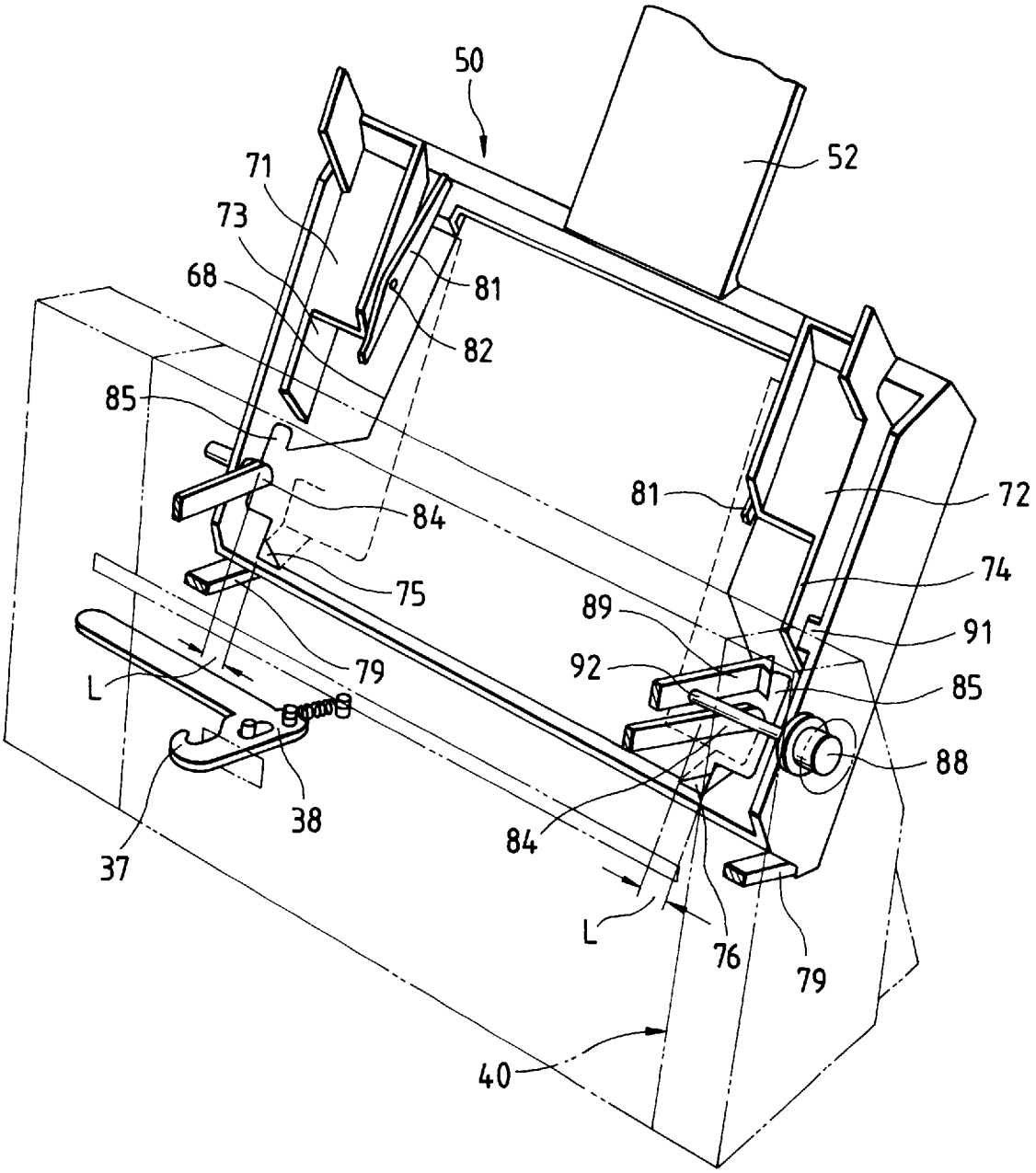
FIG. 13 is a partially omitted diagonal view to show typically the action mechanism between the sheet feed driving unit and sheet feeding cassette of the automatic sheet feeding apparatus.

FIG. 13 is a structural drawing to indicate various engaging members which function when the sheet feeding cassette 50 is changed-over to the perpendicular sheet set position or inclined sheet feeding position.

In FIGS. 9 and 13, stoppers 79, 79 which contact the lower part of sheet feeding cassette 50 and hold the said cassette in inclined position (sheet feeding position) are formed at both sides of the casing of sheet feed driving unit 40.

The sliders 71 and 72 at both sides are provided with the sheet entry preventing means (sheet entry preventing lever) 81, 81 for preventing the insertion (mounting) of recording sheet 13 when the apparatus is in sheet feeding mode. These levers 81, 81 are axially supported at the sliders 71 and 72 by pins 82, 82 in the freely rotating state and as shown in FIG. 9, they rotate by their own weight in the sheet feeding mode and their upper ends contact the upper plane of the loaded sheet 13 at the point near the sheet inlet 83. Therefore, even when an operator should try to insert the recording sheet 13, the front end of the sheet is blocked by the front end of the sheet entry prevention levers 81, 81 and it can not enter into the cassette.

When the sheet feeding cassette 50 is turned to the perpendicular sheet set position, the lower ends of the sheet entry prevention levers 81, 81 hit the edge of the casing at the side of the sheet feed driving unit 40 as shown in FIG. 10, and the said levers 81, 82 turn clockwise for preset amount and their upper ends are lifted to open the sheet inlet 83 as shown by the Figure. Thus, the recording sheet 13 can be inserted into the cassette through the sheet inlet 83.

As shown in FIGS. 10 and 13, pressure plate pushing members 84, 84 which project toward the cassette 50 are provided at both sides of the casing of sheet feed driving unit 40 and when the sheet feeding cassette 50 is turned to roughly perpendicular sheet set position, the said pressure plate pushing members 84, 84 contact the lugs 85, 85 (FIG. 12) formed at both sides of the pressure plate 68 and thereby the pressure plate 68 is pushed down. Thus, the space between the sheet feeding roller 41 and pressure plate 68 is widened, sheet insertion space 86 is formed for recording sheet 13 and the system becomes ready for setting the recording sheet 13, as shown in FIG. 10.

Under such status, the separation claws 75, 76 are held at the level equal to the sheet feeding roller 41 (which is positioned at the retreating angle) or somewhat overlapping therewith as shown in FIG. 10 and a guiding projection 87 with the height somewhat projecting above the sheet feeding roller 41 toward the cassette side is formed at the inlet side of the sheet feeding roller 41 of the casing of the sheet feed driving unit 40. Thus the recording sheet 13 to be inserted is securely set in between the separation claws 75, 76 and the pressure plate 68.

The contacting position at the time when the said pressure plate 68 is pushed down (the position of pressure plate pushing members 84, 84) is the position wider than the maximum moving range of separation claws 75, 76 toward both sides by the distance L and it is outside of the width of the recording sheet 13 having maximum width.

Sheet feeding cassette 50 is maintained at the sheet set stage (perpendicular position) by locking mechanism which can be released by button 88 (FIGS. 10 and 13). This locking mechanism is composed of the hook lever 89 projecting at the end of the casing of the sheet feed driving unit 40 and the hooking part 91 formed at the edge of the sheet feeding cassette 50 and the lock is engaged when it is turned to the sheet setting state to hook the aforesaid members. The said locking mechanisms 89, 91 are released when the said button 88 is depressed, hook lever 89 is deformed by elasticity by the edge 92 (FIG. 13) of the said button 88, thus disengaging the lever from the hooking part 91.

Figure 14:
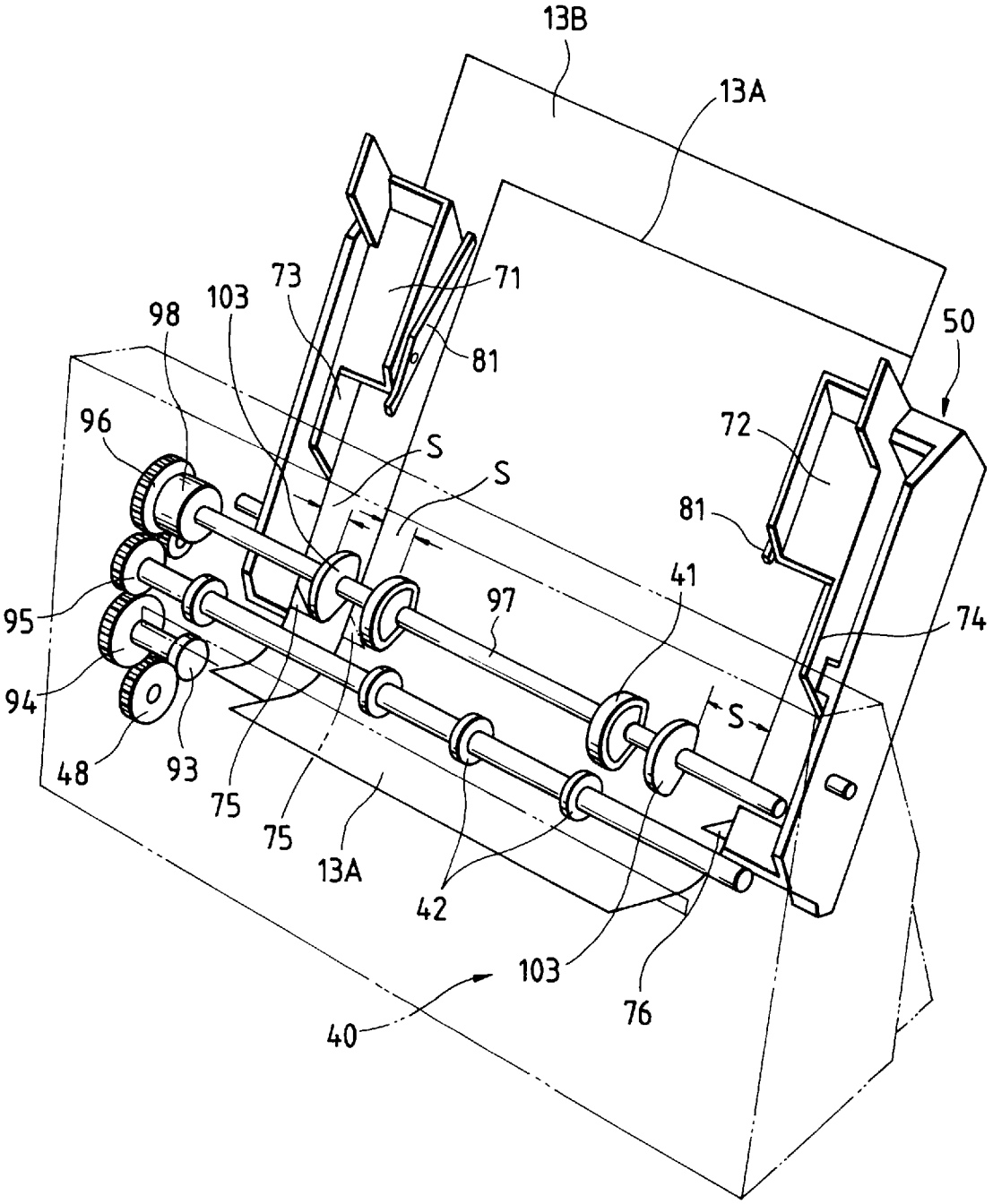
FIG. 14 is the partially omitted diagonal view to show typically the driving mechanism of sheet feeding roller of automatic sheet feeding apparatus of FIG. 9.

FIG. 14 is a diagonal view to indicate the arrangement of the sheet feeding roller 41 and the driving system of sheet feeding roller 41, in which FIG. 14, the rotation of the driven gear 48 which turns in synchronous with sheet feeding to recording apparatus 10 is transmitted to the sheet feeding roller shaft 97 via the gears 93, 94, 95 and 96.

Here a clutch 98 is provided in between the gear 96 and sheet feeding roller shaft 97. The clutch 98 used here may have, for example, such composition as to function as follows:

In synchronous with the rotation of sheet transporting roller (platen roller) 14 in the reverse direction of printing for the preset amount, which is effected according to the sheet feeding signal, the spring clutch means makes reverse turn and the engagement with the hook in printing direction is released and clutch 98 is changed over form OFF to ON.

By turning the sheet feeding roller (semicircular roller) 41 in synchronization with the rotation of platen roller 14 in the printing direction for preset amount with the clutch at ON position, one recording sheet 13 is separated and one sheet is fed up to the position surpassing the sheet drawing-in section of platen roller 14. Then, by turning the platen roller 14 in the reverse direction of printing for preset amount, the front end of the recording sheet 13 is made to retract to the position escaping from the sheet drawing-in section while the rotation of semicircular sheet feeding roller 41 is stopped. Next, by the rotation of platen roller 14 and sheet feeding roller 41 in the printing direction, the recording sheet 13 is carried to the printing position, the clutch becomes OFF and sheet feeding roller 41 produced in between the said roller 41 and the recording sheet 13 and thus synchronization between platen roller 14 and sheet feeding roller 41 is released. Thus, only one recording sheet 13 is fed as sheet feeding roller 41 makes one rotation.

As explained in FIGS. 11 and 12, side guides 73, 74 which execute width control of the recording sheet 13 and separation claws 75, 76 which engage with the recording sheet 13 at both sides of its front end are provided to the sliders 71, 72 which adjust the space in width direction according to the width of the loaded recording sheet 13. These members are operated together by manual control and by setting the clamp levers 101, 102 (FIGS. 11 and 12) at the position as shown in the drawing, the guide groove (not shown in the drawing) is clamped from both sides by the edge cam means (not shown in the drawing) and thus the groove is set at the position suitable for the specified width by friction force.

On the other hand, the sheet feeding roller 41 is fixed on the sheet feeding roller shaft 97 so that it should not move in the width direction either.

A pair (two) of roller are used for the sheet feeding roller 41 and they are arranged at the specified position and space as shown in FIGS. 12 and 14. Two semicircular sheet feeding rollers 41 and 41 are so arranged that when a small size recording sheet 13A is loaded, the space S, S up to the separation claws 75, 76 located at the outside becomes the proper range (or value) suitable for displaying separation function.

A pair of dummy rollers 103, 103 are fixed at outside of the two sheet feeding rollers 41, 41 of the said sheet feeding roller shaft 97. These dummy rollers 103, 103 have the same profile as the sheet feeding rollers 41, 41 but the material of construction and width of rollers are different and their friction resistance with the recording sheet 13 is smaller and therefore although they slidingly contact the sheet during sheet feeding but sheet delivery force is not produced thereby.

For example, the outer cricumference of the sheet feeding rollers 41, 41 is made of rubber etc. which produces a large friction force but that of the dummy rollers 103, 103 is made of plastics such as Teflon or Nylon (trade mark) and their outer circumference is made smooth.

Both or one of the dummy rollers 103, 103 are arranged at such position that when recording sheet 13B of large or medium size is loaded, the space up to the separation claws 75, 76 at its outside should become a proper range (or value) suitable for the separation function as stated above.

By additionally providing the dummy rollers 103, 103 having such simple construction, the space between the separation claws 75, 76 and the inside sheet holding position is set within the proper range (proper value) to form an appropriate loop at front end of the recording sheet at the start of sheet feeding, even when recording sheets of different widths are used and the sheet feeding rollers 41, 41 are fixed in axial direction. That is, even when the sheet width varies, it is possible to maintain the proper loop forming position while employing the two fixed sheet feeding rollers 41, 41. Therefore, it is unnecessary to use the expensive sliding rollers (making axial direction sliding) for sheet feeding rollers 41, 41 and it contributes to cost reduction.

Besides, when sliding rollers are used for sheet feeding rollers 41, 41, friction resistance increases at the adjustment of width and the margin of overlap of recording sheet 13 and separation claws 75, 76 tends to fluctuate and reliability of sheet feeding action decreases but when the aforesaid dummy rollers 103, 103 as used in the present application of invention are used, such disadvantage is eliminated.

It is also possible to use sheet feeding rollers 41, 41 instead of dummy rollers 103, 103, using in total four sheet feeding rollers. However with such set-up, it is practically impossible to obtain a uniform contact pressure against the recording sheet 13 at all four rollers and the sheet delivery forces at four sheet feeding rollers will vary and it may cause slanted movement of sheet, thus it is practically impossible to employ such system.

Figure 15:
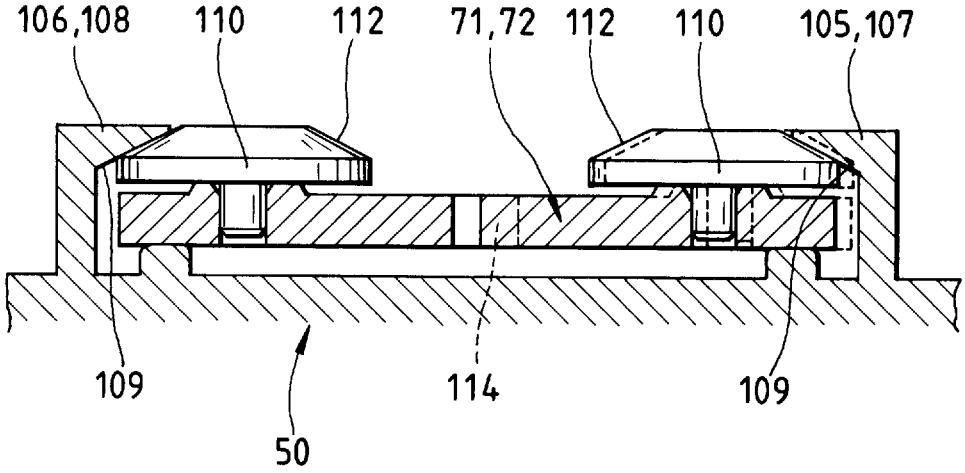
FIG. 15 is the longitudinal sectional drawing to show typically the guide roller of the slider along the line XV—XV in FIG. 11.

In reference to FIG. 11 and FIG. 15 which is the partial sectional drawing along line XV—XV of FIG. 11, the construction of guides of the aforesaid sliders 71, 72 is explained.

In both drawings, the guide rails 105, 106, 107 and 108 are provided at the inner surface of the casing of sheet feeding cassette 50 and the slider 71 at the left side is guided by the guide rails 105 and 106 and the slider 72 at the right side is guided by the guide rails 107 and 108.

The aforesaid guide rails 105~108 may be made of the two connected guide rails above and below but in the present embodiment, it is partially installed in the range to cover the maximum range of motion of the sliders 71 and 72. The guide rails 105~108 are made of the dovetail guide rail which has dovetail groove (a groove with tapered plane) 109 at inside as shown in FIG. 15.

In the example shown in the Figure, the guide rails 105~108 are formed into one piece with the main body of the plastic casing of sheet feeding cassette 50.

A guide roller 110 which rotates while being in contact with the said dovetail groove 109 of the guide rails 105~108 is axially and rotatably supported by each of the sliders 71 and 72. In case of the example shown in the drawing, one upper and two lower guide rollers in total three guide rollers 110 are axially supported by each of the sliders 71, 72 as shown in FIG. 11 and sloped planes (having roughly identical angle of slope) 112 engaging with the sloped plane of the corresponding dovetail groove 109 are formed at each guide roller 110 as shown in FIG. 15.

Thus, at the adjustment of width to match the side guides 73 and 74 with the recording sheet 13, the sloped plane 112 of each guide roller 110 is brought in contact with each dovetail groove 109 and thus one or both of the sliders 71 and 72 are made to move (with the construction of FIG. 11, width adjustment is made by moving mainly the left side slider 71 only as illustrated in FIG. 14).

At such time, each guide roller 110 rotatory moves along the sloped plane of dovetail groove 109 and consequently the resistance against its movement is substantially reduced.

Further, at least the guide roll at one side of the sliders 71 and 72, that is, in the example shown in the drawing, the upper side guide roller 110 of the slider 71 and 72 is supported by an elastic means so that it contacts the guide plane (sloped plane) of dovetail groove 109 at the specified pressure.

In the example shown in the drawing, the guide roller supporting part of sliders 71, 72 is formed by an arm section (elastic section) 114 which can make elastic displacement and the width of the upper and lower guide rollers in free state are set at the distance somewhat larger than the space between the upper and lower rails 105, 106 or 107, 108 so that a preliminary contact pressure is produced at the guide plane of each guide roller 110 when the sliders 71 and 72 couple with the guide rails 105~108.

By supporting the guide roller 110 via the elastic means which produces the specified contact pressure, the play at the guide section is eliminated and it becomes possible to make the sliders 71, 72 move more smoothly and accurately.

What is claimed is:

1. An automatic sheet feeding apparatus for use with a recording apparatus having a recording unit, comprising:

a sheet feeding apparatus body;

sheet storing means for storing recording sheets, said sheet storing means being supportable on said sheet feeding apparatus body;

sheet feeding means disposed in said sheet feeding apparatus body for feeding recording sheets from said sheet storing means to the recording apparatus; and supporting means provided on said sheet feeding apparatus body for movably supporting said sheet storing means thereon, said sheet storing means being movable, in a condition wherein said sheet storing means is supported on said sheet feeding apparatus body by said supporting means, between at least a substantially vertical position wherein the sheet storing means is in close proximity to said sheet feeding apparatus body and a space capable of storing recording sheets in said sheet storing means is formed, and an inclined position wherein the sheet storing means is inclined in a direction away from said sheet feeding apparatus body, wherein, when said sheet storing means is in the vertical position, recording sheets in said sheet storing means are not in close proximity to said sheet feeding means, and when said sheet storing means is in said inclined position, recording sheets in said sheet storing means are in sufficiently close proximity to said sheet feeding means to enable the recording sheets to be separated and fed toward said recording unit by said sheet feeding means.

2. An automatic sheet feeding apparatus according to claim 1, wherein said sheet storing means comprises sheet mounting means, said sheet mounting means being constructed to shift with a moving operation of said sheet storing means in a direction away from said sheet feeding means when said sheet storing means is shifted to a substantially vertical position.

3. An automatic sheet feeding apparatus according to claim 1, wherein a manual inlet enables manual feeding of a recording sheet to the recording apparatus when said sheet storing means is in said substantially vertical position.

4. An automatic sheet feeding apparatus according to claim 1, wherein said sheet storing means is a sheet cassette, and is provided with sheet entry preventing means for blocking entry of recording sheets into said sheet storing means when said sheet storing means is in the inclined position.

5. An automatic sheet feeding apparatus according to claim 1, further comprising in combination to form a recording apparatus, a recording unit which forms an image by applying thermal energy to a recording liquid to form liquid droplets thereof.

6. An automatic sheet feeding apparatus according to claim 2, wherein said sheet mounting means is an intermediate panel which is urged in a direction away from said sheet feeding means when said sheet storing means is in said substantially vertical position.

7. An automatic sheet feeding apparatus according to claim 4, wherein said sheet entry preventing means is pivoted to be shifted to a retracted position when said storing means returns to the substantially vertical position by its own weight.

8. An automatic sheet feeding apparatus according to claim 1, wherein said automatic sheet feeding apparatus is mounted on a side of the recording apparatus.

9. An automatic sheet feeding apparatus according to claim 3, wherein said sheet feeding means feeds each recording sheet substantially horizontally to the recording apparatus when said sheet storing means is in an inclined position.

10. An automatic sheet feeding apparatus according to claim 1, further comprising a rotation transmitting means for receiving a rotational force from the recording unit and transmitting it to said sheet feeding means for feeding a stored sheet.

11. An automatic sheet feeding apparatus according to claim 10, wherein said automatic sheet feeding apparatus is detachably mounted on a side of the recording apparatus.

12. An automatic sheet feeding apparatus for use in a substantially vertically upright position with a recording apparatus having a recording unit, comprising:

a sheet feeding apparatus body;

sheet storing means for storing recording sheets, said sheet storing means being supportable on said sheet feeding apparatus body;

sheet feeding means disposed in said sheet feeding apparatus body for feeding recording sheets from said sheet storing means to the recording apparatus;

support means provided on said sheet feeding apparatus body for movably supporting said sheet storing means thereon, said sheet storing means being movable, in a condition wherein said sheet storing means is supported on said sheet feeding apparatus body by said supporting means, between at least a substantially vertical position wherein a space capable of storing recording sheets in said sheet storing means is formed, and an inclined position wherein recording sheets in said sheet storing means are in sufficiently close proximity to said sheet feeding means to enable the recording sheets to be separated and fed toward said recording apparatus by said sheet feeding means; and sheet entry preventing means for blocking entry of recording sheets into said sheet storing means when said sheet storing means is in the inclined position.

13. An automatic sheet feeding apparatus according to claim 12, wherein said sheet entry preventing means is pivoted to be shifted to a retracted position when said storing means returns to the substantially vertical position by its own weight.

14. An automatic sheet feeding apparatus according to claim 12, wherein said sheet storing means comprises sheet mount means, said sheet mount means being constructed to shift with a moving operation of said sheet storing means in a direction away from said sheet feeding means when said sheet storing means is shifted to a substantially vertical position.

15. An automatic sheet feeding apparatus for use with a recording unit, comprising:

a sheet feeding apparatus body;

sheet storing means for storing recording sheets, said sheet storing means being supportable on said sheet feeding apparatus body;

sheet feeding means disposed in said sheet feeding apparatus body for feeding recording sheets from said storing means to the recording apparatus;

supporting means provided on said sheet feeding apparatus body for movably supporting said storing means thereon, said storing means being movable, in a condition wherein said sheet storing means is supported on said sheet feeding apparatus body by said supporting means, between at least a non-feed position where said sheet feeding means and a sheet are separated, and a feed position where said sheet feeding means and a sheet are contactable; and sheet entry preventing means for blocking entry of recording sheets into said sheet storing means when said sheet storing means is in the feed position.

16. An automatic sheet feeding apparatus according to claim 15, further comprising in combination to form a recording apparatus, a recording unit which forms images by applying thermal energy to a recording liquid to form liquid droplets thereof.

17. An automatic sheet feeding apparatus according to claim 15, wherein said sheet storing means comprises sheet mount means, said sheet mount means being constructed to shift with a moving operation of said sheet storing means in a direction away from said sheet feeding means when said sheet storing means is shifted to a substantially vertical position.

18. A recording apparatus having a recording unit provided with an automatic sheet feeding apparatus, said sheet feeding apparatus comprising:

a body;

a sheet storing means for storing recording sheets;

a sheet feeding means for feeding a recording sheet from said sheet storing means to said recording apparatus; and supporting means provided on said body for movably supporting said sheet storing means thereon, said sheet storing means being movable, in a condition wherein said sheet storing means is supported on said body by said supporting means, between at least a substantially vertical position wherein the sheet storing means is in close proximity to said body and a space capable of storing the sheets in said sheet storing means is formed and an inclined position wherein the sheet storing means is inclined in a direction away form said body, wherein, when said sheet storing means is in the vertical position, the recording sheets in said sheet storing means are not in close proximity to said sheet feeding means, and when said sheet storing means is in the inclined position, the recording sheets in said sheet storing means are in sufficiently close proximity to said feeding means to enable the recording sheets to be separated and fed toward said recording apparatus by said sheet feeding means.

19. A recording apparatus according to claim 18, wherein said recording unit forms images by applying thermal energy to a recording liquid to form liquid droplets thereof.

20. A recording apparatus according to claim 18, wherein said sheet storing means comprises sheet mounting means, said sheet mounting means being constructed to shift with a moving operation of said sheet storing means in a direction away from said sheet feeding means when said sheet storing means is shifted to a substantially vertical position.

21. A recording apparatus according to claim 20, wherein said sheet mounting means is an intermediate panel which is rotatably urged when said sheet mounting means is in the substantially vertical position.

22. A recording apparatus having a recording unit provided with an automatic sheet feeding apparatus, said sheet feeding apparatus comprising:

a body;

sheet storing means for storing recording sheets;

sheet feeding means provided in said body for feeding a recording sheets from said sheet storing means to said recording apparatus; and supporting means provided on said body for movably supporting said sheet storing means thereon, said sheet storing means being movable, in a condition wherein said sheet storing means is supported on said body by said supporting means, between at least a non-feed position where said sheet feeding means and a sheet are separated and a feed position where said sheet feeding means and a sheet can be in contact; and sheet entry preventing means for blocking entry of recording sheets into said sheet storing means when said sheet storing means is in the feed position.

23. A recording apparatus according to claim 22, wherein said recording unit forms images by applying thermal energy to a recording liquid to form liquid droplets thereof.

24. A recording apparatus according to claim 22, wherein said sheet entry preventing means is pivoted to be shifted to a retracted position when said storing means returns to the non-feed position by its own weight.

25. A recording sheet feeding apparatus according to claim 22, wherein said sheet storing means comprises sheet mount means, said sheet mount means being constructed to shift with a moving operation of said sheet storing means in a direction away from said sheet feeding means when said sheet storing means is shifted to a substantially vertical position.

26. An automatic sheet feeding apparatus for use with a recording apparatus having a recording unit, comprising:

a sheet feeding apparatus body;

sheet storing means for storing recording sheets, said sheet storing means being supportable on said sheet feeding apparatus body;

sheet feeding means for feeding recording sheets from said sheet storing means to said recording apparatus; and supporting means provided on said sheet feeding apparatus body for movably supporting said sheet storing means thereon, said sheet storing means being moveable, in a condition wherein said sheet storing means is supported on said sheet feeding apparatus body by said supporting means, between at least a substantially vertical position wherein the sheet storing means is in close proximity to said body and a space capable of storing recording sheets is formed in said sheet storing means, and an inclined position wherein the sheet storing means is inclined in a direction away from said sheet feeding apparatus body, wherein, when said sheet storing means is in the vertical position, recording sheets in said sheet storing means are not in close proximity to said sheet feeding means and, when said sheet storing means is in the inclined position, recording sheets in said sheet storing means are in sufficiently close proximity to said sheet feeding means to enable the recording sheets to be separated one by one and fed toward said recording apparatus by said sheet feeding means.

27. An automatic sheet feeding apparatus according to claim 26, wherein said sheet storing means comprises sheet mount means, said sheet mount means being constructed to shift with a moving operation of said sheet storing means in a direction away from said sheet feeding means when said sheet storing means is shifted to a substantially vertical position.

28. A recording apparatus provided with an automatic sheet feeding apparatus, said recording apparatus comprising:

a recording means;

a sheet storing means for storing recording sheets;

a sheet feeding means for feeding the recording sheets from said sheet storing means to said recording means; and attachment means for attaching said sheet storing means to said sheet feeding apparatus and for movably supporting said sheet storing means between at least a substantially vertical position wherein the sheet storing means is in close proximity to said sheet feeding apparatus and an inlet space capable of storing the sheets in said sheet storing means is formed and an inclined position wherein the sheet storing means is separated from said sheet feeding apparatus, wherein, when said sheet storing means is in the inclined position, the recording sheets in said sheet storing means are in sufficiently close proximity to said sheet feeding means to enable the recording sheets to be separated and fed to said recording means by said sheet feeding means.

29. A recording apparatus according to claim 28, wherein said recording means forms images by applying thermal energy to a recording liquid to form liquid droplets thereof.

30. A recording apparatus, comprising:

recording unit;

a sheet storing means for storing recording sheets and having a sheet mounting means;

sheet feeding means for feeding a recording sheet from said sheet storing means to said recording unit;

supporting means provided on said recording apparatus for movably supporting said sheet storing means thereon, said sheet storing means being movable, in a condition wherein said sheet storing means is supported on said apparatus by said supporting means, between at least a substantially vertical position wherein recording sheets in said sheet storing means are not in close proximity to said sheet feeding means so that a space capable of storing recording sheets in said sheet storing means is formed, and an inclined position wherein the recording sheets in said sheet storing means are in sufficiently close proximity to said sheet feeding means to enable said sheet feeding means to separate and feed recording sheets into said recording unit; and shifting means for shifting said sheet mounting means in a direction away from said sheet feeding means when said sheet storing means is shifted to the substantially vertical position.

31. A recording apparatus according to claim 30, wherein said recording unit is disposed in a substantially horizontal path.

32. A recording apparatus according to claim 30, wherein said sheet storing means is a sheet cassette, and said sheet mounting means is an intermediate panel, such that, when said sheet storing means is in said substantially vertical position, said intermediate panel is depressed in a direction away from said sheet feeding means.

33. A recording apparatus, comprising:

a recording unit;

a sheet storing means for storing recording sheets;

a sheet feeding means for feeding a recording sheet from said sheet storing means to said recording unit; and supporting means provided on said recording apparatus for movably supporting said sheet storing means thereon, said sheet storing means being movable, in a condition wherein said sheet storing means is supported on said recording apparatus by said supporting means, between at least a non-feed position wherein the recording sheets in said sheet storing means are not in close proximity to said sheet feeding means so that a space capable of storing the sheets in said sheet storing means is formed, and a feed position wherein the recording sheets in said sheet storing means are in sufficiently close proximity to said sheet feeding means to enable the recording sheets to be separated and fed into said recording unit by said sheet feeding means; and sheet entry preventing means covering an inlet space of said sheet storing means, for blocking entry of recording sheets into said sheet storing means when said sheet storing means is in the feed position.

34. A recording apparatus according to claim 33, wherein said sheet entry preventing means is pivoted to be shifted to a retracted position when said storing means returns to the non-feed position by its own weight.

35. A recording sheet feeding apparatus according to claim 33, wherein said sheet storing means comprises sheet mount means, said sheet mount means being constructed to shift with a moving operation of said sheet storing means in a direction away from said sheet feeding means when said sheet storing means is shifted to a substantially vertical position.

* * * * *

UNITED STATES PATENT AND TRADEMARK OFFICE

CERTIFICATE OF CORRECTION

PATENT NO. : 5,813,780

DATED : September 29, 1998

INVENTORS : TAKEHIKO KIYOHARA, ET AL.

It is certified that error appears in the above-identified patent and that said Letters Patent is hereby corrected as shown below:

COLUMN 2,
Line 43, "certainly" should read --certainty--, and "and" should be deleted.

COLUMN 4,
Line 45, "traying" should read --tray--; and
Line 57, "the Figure" should read --FIG. 4--.

COLUMN 6,
Line 54, "the Figure." should read --FIG. 1.--.

COLUMN 7,
Line 19, "is" should read —in —; and
Line 31, "synchronous" should read --synchronization--.

COLUMN 10,
Line 4, "synchronous" should read --synchronization--;
Line 11, "synchronous" should read --synchronization--;
Line 16, "form" should read --from--;
Line 50, "roller" first occurrence should read —rollers—; and
Line 66, "feeding but" should read --feeding,--.

UNITED STATES PATENT AND TRADEMARK OFFICE

CERTIFICATE OF CORRECTION

PATENT NO. : 5,813,780

DATED : September 29, 1998

INVENTORS : TAKEHIKO KIYOHARA, ET AL.

It is certified that error appears in the above-identified patent and that said Letters Patent is hereby corrected as shown below:

COLUMN 11,
Line 1, "cricumference" should read --circumference--; and
Line 55, "the Figure," should read --FIG. 15,--.

COLUMN 12,
Line 8, "rotatory" should read --rotatably--.

COLUMN 14,
Line 64, "form" should read --from--.

Signed and Sealed this

Eleventh Day of May, 1999

*Attest:*

*Attesting Officer*

Q. TODD DICKINSON

*Acting Commissioner of Patents and Trademarks*